United States Patent [19]

Fähnrich

[11] 4,230,518

[45] Oct. 28, 1980

[54] DEVICE FOR FIXING FOILS ON BOTTLES STANDING UPRIGHT

[75] Inventor: Adolf Fähnrich, Neutraubling, Fed. Rep. of Germany

[73] Assignee: Hermann Kronseder, Worth, Fed. Rep. of Germany

[21] Appl. No.: 67,579

[22] Filed: Aug. 17, 1979

[30] Foreign Application Priority Data

Sep. 16, 1978 [DE] Fed. Rep. of Germany ..... 2840404

[51] Int. Cl.[2] ..... B65C 9/04

[52] U.S. Cl. ..... 156/456; 156/487; 156/488

[58] Field of Search ..... 156/487, DIG. 19, 447, 156/448, 456–458, 486, 488, 493; 53/291, 296, 399, 582, 588

[56] References Cited

U.S. PATENT DOCUMENTS

| | | | |
|---|---|---|---|
| 2,867,957 | 1/1959 | Rohbogner | 53/296 |
| 3,567,551 | 3/1971 | Dullinger | 156/391 |
| 3,784,438 | 1/1974 | Dullinger | 156/487 |

*Primary Examiner*—David A. Simmons

*Attorney, Agent, or Firm*—Ralph G. Hohenfeldt

[57] ABSTRACT

Apparatus for applying decorative metallic foils to the necks and over the closure elements of bottles. The bottles are orbited past a foid depositing element on a revolving table on which each bottle is supported on a turntable and stabilized by a retractable plunger. The adhesive coated foils are square or rectangular and are deposited so a pair of foil corners project up and down and a pair project laterally. A roller assembly bends in the lateral corners or points as the revolving table revolves. At a transfer area between the revolving table and a bottle removal star wheel a deflector bends down the upwardly projecting foil point. Variously oriented rotating brushes act on the foils when the bottles are on the star wheel and are rotating to finish the foil forming operations.

7 Claims, 5 Drawing Figures

DEVICE FOR FIXING FOILS ON BOTTLES STANDING UPRIGHT

The invention relates to a device for fixing and forming decorative foils on bottles.

Equipping bottle necks with a so-called pointed foil, using essentially rectangular or square-cut pieces having four corner points, has economical advantages over using foils that are stamped out to fit specific bottle shapes because the square-cut or rectangular pieces can be produced in the most simple manner by a few straight cuts. However, processing these cut pieces in bottle labeling machines is problematical. In particular, flattening the point or corner which initially points upwardly above the bottom closure and subsequently properly smoothing the point around the bottle head is very difficult because of the relatively large overhand; that is, great material excess in the area of the bottle closure. It should be made certain, on the one hand, that both the bottle closure and the bottle head are covered with foil completely while, on the other hand, excessive material accumulations leading to ugly thickenings and pleats and to a point which extends far down the bottle neck and is vulnerable to being bent up by the gripper claws during the automatic packaging of the bottles should be avoided.

In one known device of the kind just mentioned, the cut-piece end or corner of the foil which projects upwardly is folded over 180° or reentrantly in the labeling device before being glued to the bottle, thereby reducing the effective height of the foil piece. After laying on and overlapping the two cut-piece corner points which extend laterally in the area of the bottle neck when cut-piece is first applied, the bottles are transferred in disarray to the subsequent transport star, where a rotary motion is imparted to them. In this process, the foil piece area projecting upwardly beyond the bottle closure is pointed and leveled out by smoothing strips and more smoothing is done by means of brushes or the like. In this known machine, malfunctions within the labeling device when folding the thin foil material cannot be avoided, and it may happen that, when raising the vertically movable plunger which temporarily stabilizes the bottle, the folded end is bent up again completely or partly in the unloading area of the revolving table, which leads to an extremely ugly appearance of the foil covered part of the bottles. Because of the disorderly bottle transfer to the transport star there is no assurance that the projecting cut-piece foil areas enter the smoothing strips in the most favorable position so that it is hardly possible to have the foiled bottles look alike. Moreover, ugly thickenings at the bottle closure can occur when folding over the double foil overhang.

It is an object of the invention to improve apparatus for applying foils to bottles so as to make possible in simple manner a complete and uniform pressing of the foil piece point projecting upwardly around the bottle closure or bottle head without having to fold over this foil piece point in the area of the labeling device.

In a machine according to the invention, the foil piece point or corner which projects upwardly is folded over when still in the area of the revolving table, that is, when the bottle is still standing on the turntables with other bottles and in a predetermined alignment, shortly after the vertically movable plungers are raised off the bottle closure. This is possible because the bottles have already entered the pockets of the transport star more or less, and therefore cannot tilt while being treated by the deflector which is used for bending down the upwardly projecting point or corner. Accordingly, the deflector, active during the transfer of the bottles from the table to the transport star, makes possible a precisely controllable, exactly defined folding over of the foil piece points projecting upwardly so that they cover completely the horizontal surface of the bottle closure smoothly. The machine according to the invention makes possible reproducible foil forming and, therefore, an extremely uniform appearance of the foiled bottles. In addition, it makes possible the processing of cut pieces smaller in area than in the known machine, thus offering a significant cost advantage, again due to the exact fold formation which assures complete coverage of the bottle closure or bottle head even if the pieces are cut scantily.

A particularly advantageous feature of the invention results from having the deflector for the upwardly extending foil point located approximately on the connecting line between the axis of rotation of the revolving table and the axis of rotation of the transport star. In such case, the deflector engages each bottle while it is still standing exactly concentric on the respective turntable on the one hand, thus having the desired angular position, and already having entered fully a transport star pocket on the other hand, thus being optimally stabilized. Of course, slight deviations from this ideal deflector position are also possible without major disadvantages. It is important that the bottles have no opportunity to change their desired angular position before being acted upon by the deflector. This can be accomplished in that, according to a further development of the invention, a stationary guide yoke is provided to engage the bottles immediately after they have passed the deflector since the stationary guide yoke which has to divert the bottles from their original path of motion with the revolving table, often rotates the bottles a small amount, thus changing their angular position.

According to another feature of the invention, the deflector is formed by a yoke which is arched downwardly and has its end which contacts the arriving bottles mounted so as to be rotatable about a horizontal axis and swingable upwardly against the force of a spring. This achieves a gentle and uniform folding over of the projecting cut-piece point on each bottle regardless of variations in the dimensions of the bottles and the cut pieces.

A more detailed description of a preferred embodiment of the invention will now be set forth with reference to the drawings.

DESCRIPTION OF A PREFERRED EMBODIMENT

Figure 2:
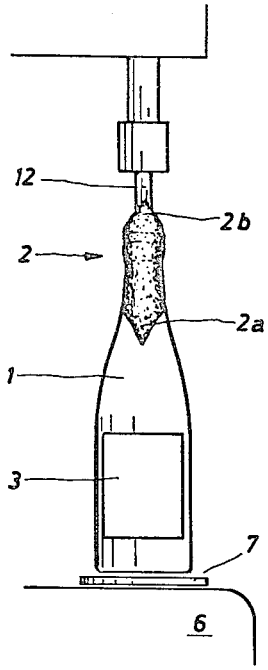
FIG. 2 is a front view of a bottle in position II in FIG. 1.

The machine for providing bottles 1, standing upright, with a sheath formed by a piece of metal foil 2 in the form of a so-called pointed foil, that is, with a corner or point 2*a* running down the bottle neck, is integrated in a labeling machine, shown only in part, in which the bottles 7 are also provided with a label 3. The bottles 1 are fed in by a hinged link chain 4, spaced apart by a conveyor worm, not shown, and placed on a table 6, comprising a spoked wheel, by a loading star wheel 5 driven the direction of the arrow on it. Table 6 is mounted in the labeling machine so as to be rotatable about a vertical axis and driven synchronously with the loading star 5. Rotatably mounted in table 6 are turntables 7 which accept the series of bottles 1, each turntable being controllable by means of a pinion 8 mounted on its shaft, a gear segment 9 meshing therewith and having a cam roller 10, and a cam slot 11 stationarily disposed below the table 6. Plungers 12, see FIGS. 2, 3 and 5, orbit with the table 6 and are raisable and lowerable in a controlled manner to stabilize bottles 1 on the turntable 7.

The bottles 1, clamped between the turntables 7 and the plungers 12 after their transfer by the loading star 5, first pass a labeling device 13 shown only in part, by means of which the square-cut or rectangularly-cut aluminum foil pieces 2 and the labels 3 are taken out of magazines, coated with glue, and pressed against the bottles 1 passing by. Each foil piece 2 is initially adhered to the neck of a bottle oriented more like a diamond than a square, that is, with one of the corners or points of the foil projecting above the top of the bottle closure, the opposite point projecting downwardly along the neck of the bottle and with the other points projecting in opposite lateral directions. Subsequently, the two points of the foil piece 2 projecting laterally are one after the other placed against the bottle 1 and smoothed out by a number of brushes, sponge rollers or the like, not shown, the bottle position being controlled by the turntables 7 and the cam slot 11, respectively. The labels 3 are brushed on at the same time.

The next to the last operation on a bottle while still on revolving table 6 consists of a consolidation of the overlap point of the two lateral cut-piece points by means of several sponge rollers 14, for which purpose the bottles 1 are turned so that the overlap point is oriented to the side transverse to the bottle travel direction. The corresponding bottle position is marked I in FIG. 1. This operation is followed by a bottle rotation of approximately 90° so that the front or label side of the bottles 1, the foil piece point **2*a* running down the bottle neck, and the foil piece point 2*b* projecting upwardly beyond the cap, cork or other closure is oriented exactly forward, that is, in the travel direction. The corresponding bottle position is designated II in FIG. 1**.

It is in angular position II that the bottles 1 reach the bottles transfer area between the table 6 and a transport star 15 following it. The transport star 15 consists of two mutually superposed star wheels, of which the upper one only can be seen. Star wheel 15 is driven in synchronism with the table 6 as indicated by the arrow on the star wheel. Associated with each pocket 16 of the transport star wheel 15 are freely rotatable rolls 17, mutually superposed in pairs and enabling the bottles 1 to rotate easily. Also provided on the periphery of the transport star wheel 15 is a stationary guide yoke 18 which guides the bottles 1 along an arc-shaped path and retains them in the pockets 16. In the starting area **18*a*, that is, in the transfer area between the table 6 and the transport star 15, the guide yoke 18 is designed so that it is closely spaced from and opposite from the bottles I which are still standing on the turntables 7. The rest of the guide yoke 18 is provided with an elastic friction coating 19 into which the bottles 1** penetrate, thereby imparting to them a rotary motion.

Figure 1:
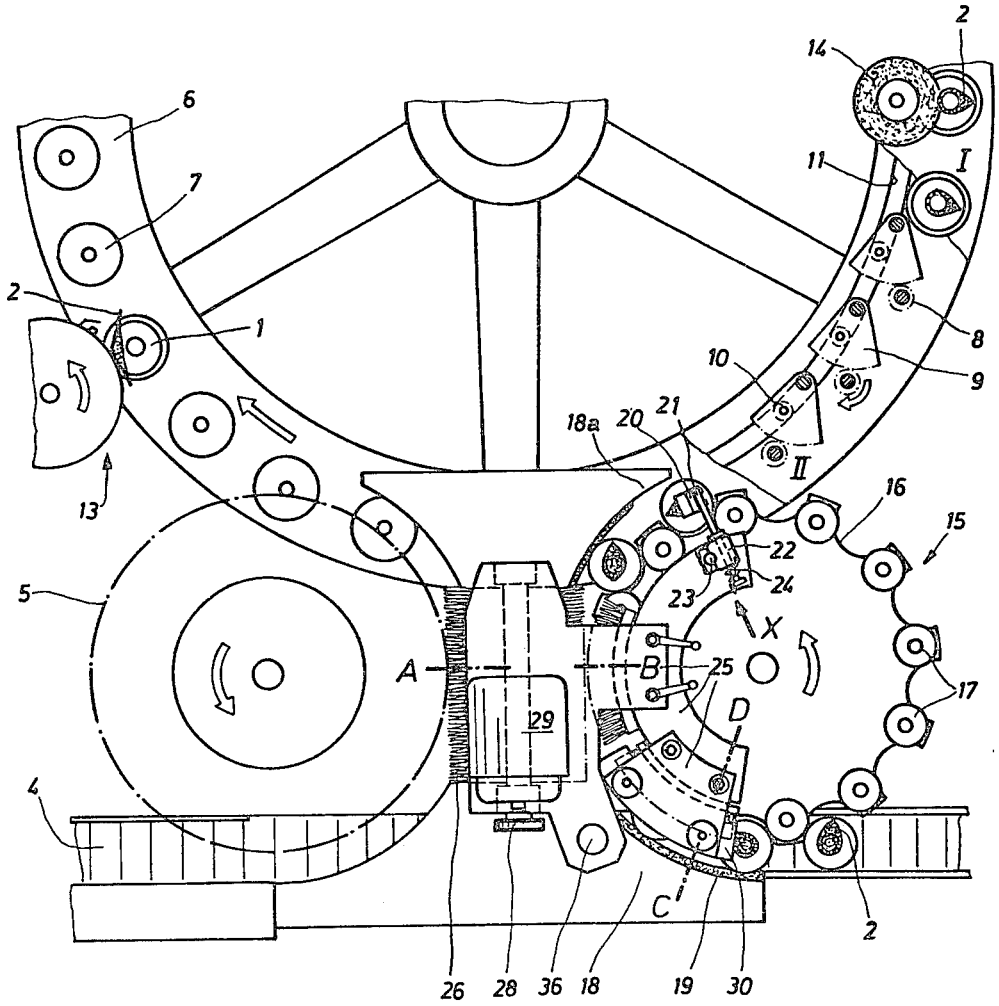
FIG. 1 is a partial top view of a machine for foiling bottles.
Figure 3:
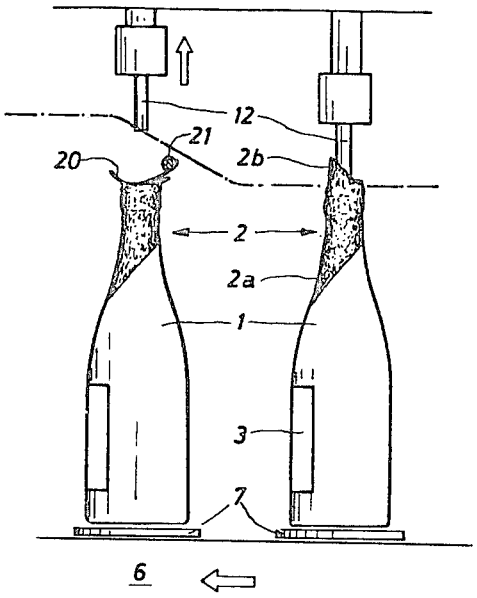
FIG. 3 is a view looking in the direction of the arrow "X" in FIG. 1.

A deflector 20, see FIGS. 1 and 3, is disposed in the transfer area between table 6 and transport star and on the connecting line between the axes of rotation of both table 6 and transport star 15 in the path of motion of the upwardly projecting foil piece points **2*b*. This deflector 20 consists of a yoke made of a strip of downwardly curved sheet metal and is slightly wider than the bottle closure. At the deflector end facing the arriving bottles the deflector 20 is fastened to a horizontal rod 21. Rod 21 is rotatably mounted in a bearing block 22 which, in turn, is clamped to a vertical holding rod 23, thus making the deflector height adjustable. Seated on the other end of rod 21 which projects out of the bearing block 22 is a helical spring 24 fastened at one end to the rod 21 and at the other end to the bearing block 22 in such a manner that it tends to twist the deflector 20 downwardly. The deflector's lower end position is fixed by an adjustable stop, not shown. As is evident from FIG. 3, deflector 20 is disposed directly below the path of motion, shown dash-dotted, of the stabilizing plungers 12 which, at this point, are already lifted off the bottles 1. Therefore, the retraction of the plungers 12, conventionally starting somewhat before the complete entry of a bottle 1 into the respective pocket 16 of the transport star 15, is not impeded by the deflector 20. The entire bottom area of a bottle 1 passing underneath the deflector 20 is still standing on a turntable 7, and in the angular position designated II, so that the deflector 20 bends the projecting foil points 2*b* exactly backwards, that is, opposite to the bottle travel direction, pressing them against the top and usually horizontal surface of the bottle closure. On the other hand, the bottles 1 are already seated completely in the pockets 16 of the transport star 15, for which reason they cannot tilt while being treated by the deflector 20. Shortly after the upwardly projecting foil points 2*b* are folded over, the bottles 1 approach the starting zone 18*a* of the guide yoke 18 and are guided by it down from the turntables 7 and around the transport star 15 in a circular path, a rotation of their own being imparted to them by the friction coating 19**.

Figure 4:
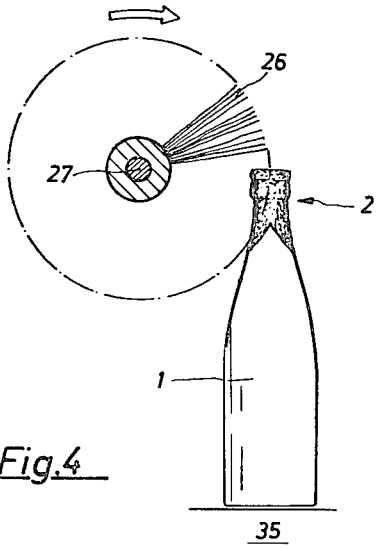
FIG. 4 is the partial section AB in FIG. 1.

Disposed above the guide yoke 18 on a carrying frame 25 is a cylindrical brush roller 26 mounted on a horizontal shaft 27. This shaft 27 is driven from a motor 29 via a belt connection 28 in such a manner that brusher roller 26 acts upon the bottles 1 from top to bottom as illustrated in FIG. 4. The brush roller 26 is disposed tangential to the transport star 15 so that the bottles 1 penetrate the bristles on brush roller 26 up to their center at most. This causes those parts of the upper foil points **2*b* which have been folded over by the deflector 20** before, but possibly still extending out laterally to be pushed downwardly against the bottle closure or bottle head, and causes the foil at the horizontal surfaces of the bottle closure, at the lateral edges of the bottle closure and in the upper area of the bottle neck to be nicely polished and pressed on lastingly.

Figure 5:
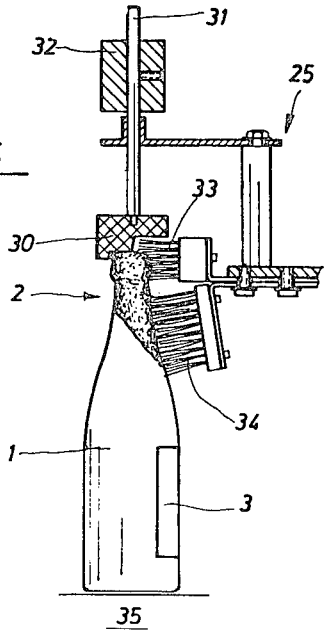
FIG. 5 is the section CD in FIG. 1.

After the brush roller 26 in FIG. 1 there is an arc-shaped smoothing strip 30 which, by means of two rods 31 fastened to it, is mounted to the carrying frame 25 so as to be height adjustable. The smoothing strip assembly is also shown in FIG. 5. The lower end position of the smoothing strip 30 is determined and the desired contact pressure obtained by weights 32 adjustably fastened to the rods 31. The generally horizontal, arc-shaped working surface of the smoothing strip 30 is disposed so that it rests on the upper horizontal surface of the bottle closure, roughly to the bottle center. Laterally adjoining the working surface is a recess, engaged by a brush 33 fastened to the carrying frame 25. Pleats possibly existing at the bottle closure are smoothed out by the smoothing strip 30 and the brush 33, and the foil is caused to hug the contour of the bottle closure tightly. Another brush 34 which causes the lower part of the cut foil 2 to adhere to the bottle neck and to smooth it is fastened to the carrying frame 25 below the brush 33. Similar brushes may also be provided in the area of the brush roller 26.

After the action of the smoothing strip 30 and the coordinated brushes 33 and 34 while the bottles are rotating, the treatment of the cut foil pieces 2 is concluded and the bottles 1 leave the transport star 15, whereupon they are transported away by the hinged link chain 4. In the transfer area between the bottle table 6 and the hinged link chain 4 the bottles 1 are standing on a support rail 35. Like the other treatment elements, the deflector 20 or its holding rod 23 is fastened to the carrying frame 25 which consists of several components mutually staggered heightwise and which, in turn, is clamped to a vertical column 36 fastened in the labeling machine.

I claim:

1. A machine for applying foils to bottles including:

a generally circular table for rotating about a vertical axis in a horizontal plane, a plurality of bottle supporting turntables arranged in circumferential spaced relationship around said table and rotating about vertical axes, means along the rotational path of said table for loading bottles having closures onto successive turntables, plunger means advanceable to engage the closure of bottles for stabilizing them on said turntable and retractable to release said bottles at a transfer area which is angularly displaced from where said bottles are loaded, foil depositing means displaced in the rotational direction of said table from said loading means for depositing a foil piece on the neck portion of a bottle on a passing turntable, said foil piece having corner points, said depositing means being operative to deposit respective foils with one corner point projecting above the bottle closure, an opposite corner point projecting down along the neck of the bottle and other corner points projecting in laterally opposite directions, pressing means displaced along the circumferential path of said table for pressing said laterally extending corner points against the bottle before the bottle reaches said transfer area, star wheel means rotating about a vertical axis adjacent said transfer area, said star wheel means having circumferentially spaced pocket means for engaging successive bottles and transferring them from said rotating table, rotation of said turntables causing the fronts of said bottles and the upwardly projecting corner point of said foil piece to be presented in the direction of bottle motion when the bottle is in said transfer area, and deflector means in said transfer area in the path of bottle motion operative when said plunger means has retracted to fold said upwardly projecting corner point of said foil piece over said closure.

2. The machine according to claim 1 wherein:

said deflector means comprises a spring biased strip having a generally downwardly convex surface for making tangential wiping contact on said upwardly projecting corner point to effect said folding.

3. The machine according to any of claims 1 or 2 wherein said deflector means is located approximately on a straight line between the rotational axis of said table and the rotational axis of said star wheel means.

4. The machine according to claim 1 including:

a fixed curved guide member adjacent said transfer station and in concentric spaced relationship with said star wheel means, said star wheel means transferring said bottles into contact relationship with said guide member immediately after said bottles have passed the deflector means, said bottles then being constrained against said guide member and maintained in motion under rotational influence of said star wheel means, said star wheel means having rollers on vertical axes adjacent said pocket means for making tangential contact with bottles in said pockets and enabling said bottles to rotate under the influence of being moved along said guide member, a power driven brush disposed for rotation in the path of motion of said bottles and for rotation from the top toward the bottom of said bottles while they are between said guide member and star wheel means, said brush further smoothing said foil pieces as they are transported rotationally past it.

5. The machine according to claim 4 wherein said guide member is lined with a resilient frictional material for inducing rotation of said bottles.

6. The machine according to claim 5 including:

a smoothing element having a surface arranged to effect a wiping force on the foil portion covering the top of a bottle closure as the bottle is carried past it by said star wheel means, said smoothing element being supported for yielding vertically and being weighted for effecting the desired wiping force.

7. The machine according to any of claims 5 or 6 including:

additional brush means located in the path of bottle motion while said bottles are moved by said star wheel means, said additional brush means extending vertically along the neck of the bottle at least coextensive with said foil piece for effecting a further wiping and smoothing action on said foil as said bottles are rotating under the influence of said guide member.

* * * * *